US005898950A

United States Patent [19]

Spyrou et al.

[11] Patent Number: 5,898,950

[45] Date of Patent: May 4, 1999

[54] PROTECTIVE HELMET

[75] Inventors: Evangelos Spyrou; Jean-Bernard Jouthe; Eric Fournier, all of Quebec, Canada

[73] Assignee: Sport Maska Inc., Quebec, Canada

[21] Appl. No.: 08/978,671

[22] Filed: Nov. 26, 1997

[51] Int. Cl.[6] ..... A42B 3/08

[52] U.S. Cl. ..... 2/421; 2/417

[58] Field of Search ..... 2/410, 411, 421, 2/425, 417, 422

[56] References Cited

U.S. PATENT DOCUMENTS

| | | | |
|---|---|---|---|
| 3,418,657 | 12/1968 | Lastnik et al. . | |
| 3,495,272 | 2/1970 | Tempelhof . | |
| 3,852,821 | 12/1974 | Mickel | 2/421 |
| 4,000,520 | 1/1977 | Svendsen et al. . | |
| 4,434,514 | 3/1984 | Sundahl et al. . | |
| 4,766,610 | 8/1988 | Mattes . | |
| 4,955,089 | 9/1990 | Beale . | |
| 5,012,533 | 5/1991 | Raffler | 2/420 |
| 5,079,780 | 1/1992 | Coombs et al. . | |
| 5,121,508 | 6/1992 | Grilliot et al. . | |
| 5,123,121 | 6/1992 | Broersma | 2/421 |
| 5,269,025 | 12/1993 | Broersma | 2/411 |
| 5,271,103 | 12/1993 | Darnell . | |
| 5,272,773 | 12/1993 | Kamata | 2/421 |
| 5,381,560 | 1/1995 | Halstead | 2/421 |
| 5,551,094 | 9/1996 | Navone | 2/421 |
| 5,581,819 | 12/1996 | Garneau | 2/421 |
| 5,608,918 | 3/1997 | Salvaggio | 2/421 |
| 5,638,551 | 6/1997 | Lallemand | 2/421 |
| 5,659,900 | 8/1997 | Arney et al. | 2/417 |
| 5,666,700 | 9/1997 | Anscher et al. | 2/421 |
| 5,704,072 | 1/1998 | Garneau | 2/421 |

*Primary Examiner*—Michael A. Neas
*Attorney, Agent, or Firm*—Factor and Shaftal

[57] ABSTRACT

A protective helmet comprising a protective shell and a member for releasably attaching the protective helmet to a user. The protective shell includes a front region, a rear region, a first and a second side region and an outer surface. The releasable attachment member includes a first front strap, a second front strap, an attachment member and a rear strap. The first front strap extends from the first side region of the protective shell. The second front strap extends from the second side region of the protective shell. The attachment member is associated with each of the first and second front straps. The rear strap includes an outer region and two lower extension regions. The outer region extends along the outer surface of the protective shell and the two lower extension regions extend through at least two openings in the protective shell. The lower extension regions are associated with at least one of the first and second front straps.

17 Claims, 3 Drawing Sheets

PROTECTIVE HELMET

BACKGROUND OF THE INVENTION

1. Field of the Invention

The present invention relates to helmets, and more particularly, to protective helmets for hockey and other impact sports. It will be understood that the protective helmet is not, however, limited to use in association with sports.

2. Background Art

Protective helmets have long been used for protecting, among other users, athletes participating in contact sports. In particular, helmets have long been used for the sport of hockey. Generally, these helmets comprise a protective shell that is attached to a user through straps. These straps extend from around the ear on either side of the helmet, and attach under the user's chin.

One deficiency of such an attachment is that the helmet is not secured well to the user. While such a helmet does lend some stability in movement upon impact, such conventional helmets nevertheless tend to move more than is desirable. Specifically, such a helmet tends to rotate about an axis extending through the user's ears or about an axis extending longitudinally through the user's body. For example, in certain impact situations, the rotation of the helmet can be such that the helmet can fly off the user's head, or can end up in an awkward position on the user's head—quite often resulting in injury.

Certain solutions have been developed to minimize the ability of the helmet to rotate about the user's head. For instance, certain structural members have been added to the fastening configuration of the helmet in an attempt to provide additional securement. Specifically, Garneau, U.S. Pat. No. 5,581,819 discloses the use of a rear strap which is attached to the helmet and to a lower rear plate. While such a structure is designed to purportedly minimize rotational movement of the helmet (through abutment of the rear plate with the occipital region of the user), such a structure has several drawbacks. The rear strap does not adequately cradle the user's head so as to maintain the helmet in the proper orientation. Secondly, the rear strap does not promote a strong retention structure to retain the rear plate in the proper orientation.

SUMMARY OF THE INVENTION

The invention comprises a protective helmet which includes a protective shell and means for releasably attaching the helmet to a user. The protective shell includes a front region, a rear region and first and second side regions. The releasable attachment means comprises a first front strap, a second front strap, an attachment member, means for cradling, a rear plate, a first side strap and a second side strap. The first front strap extends from the first side region of the protective shell. The second front strap extends from the second side region of the protective shell. An attachment member is associated with each of the first and second front straps. The cradling means cradles a rear portion of the user's head. The rear plate is associated with the cradling means. The first front strap extends from at least one of the cradling means or the rear plate to one of the first side region or the first front strap. The second side strap extends from at least one of the cradling means or the rear plate to at least one of the second region or the second side strap.

In a preferred embodiment, the first support strap extends from the first side strap to the first side region of the protective shell. In another preferred embodiment, the second support strap extends from the second side strap to the second side region of the protective shell.

In yet another preferred embodiment, the cradling means further comprises at least lower extension members associated with the rear region of the protective shell. The at least two lower extension members are spaced apart at a predetermined distance. In such a preferred embodiment, the at least two lower extension members are each associated with the rear strap. Preferably, the lower extension members comprise a first lower extension member and a second lower extension member. The first side strap couples the first lower extension region and the rear plate. The second side strap couples the second lower extension region and the rear plate.

In yet another preferred embodiment, the protective shell further includes an outer surface and an inner surface. The rear region of the protective shell includes at least two openings extending from the inner surface through the outer surface. A portion of the cradling means extends along at least a-portion of the outer surface of the rear region and through at least two of the at least two openings of the protective shell. In such a preferred embodiment, the cradling means comprises a single substantially U-shaped member.

In another preferred embodiment, the first and second side straps comprise a single strap member. Preferably, the first side strap is coupled with the first front strap and the second side strap is coupled with the second front strap.

In a preferred embodiment, at least one of the first and second side straps are releasably attached to the protective shell. In another preferred embodiment, the first and second side straps of the first and second front straps comprises a single integrally molded member.

Preferably, the at least one rear strap comprises a resilient yet flexible material. In a preferred embodiment, the rear plate comprises a resilient yet flexible material.

The invention may further comprise a protective helmet including a protective shell in means for releasably attaching the helmet to a user. The protective shell includes a front region, a rear region and first and second side regions and an outer surface. The releasable attachment means comprises a first front strap, a second front strap, an attachment member and a rear strap. The first front strap extends from the first side region of the protective shell. The second front strap extends from the second side region of the protective shell. The attachment member is associated with each of the first and second front straps. The rear strap includes an outer region and two lower extension regions. The outer region extends along the outer surface of the protective shell and the two lower extension regions extend through the at least two openings of the protective shell. The two extension regions are associated with at least one of the first and second front straps.

In a preferred embodiment, the protective helmet may further include a first side strap and a second side strap. The first side strap extends from the rear strap to at least one of the first side region or the first front strap. The second side strap extends from the rear strap to at least one of the second side region or the second front strap.

In yet another preferred embodiment, the protective helmet may further include at least one support strap associated with at least one of the first and second side straps or the protective shell.

In another preferred embodiment, the protective helmet may further include means for cradling a rear region of the head of the user. In such a preferred embodiment, the cradling means comprises a positioning of the two extension regions at a spaced apart distance from each other.

DETAILED DESCRIPTION OF THE DRAWINGS

Figure 1:
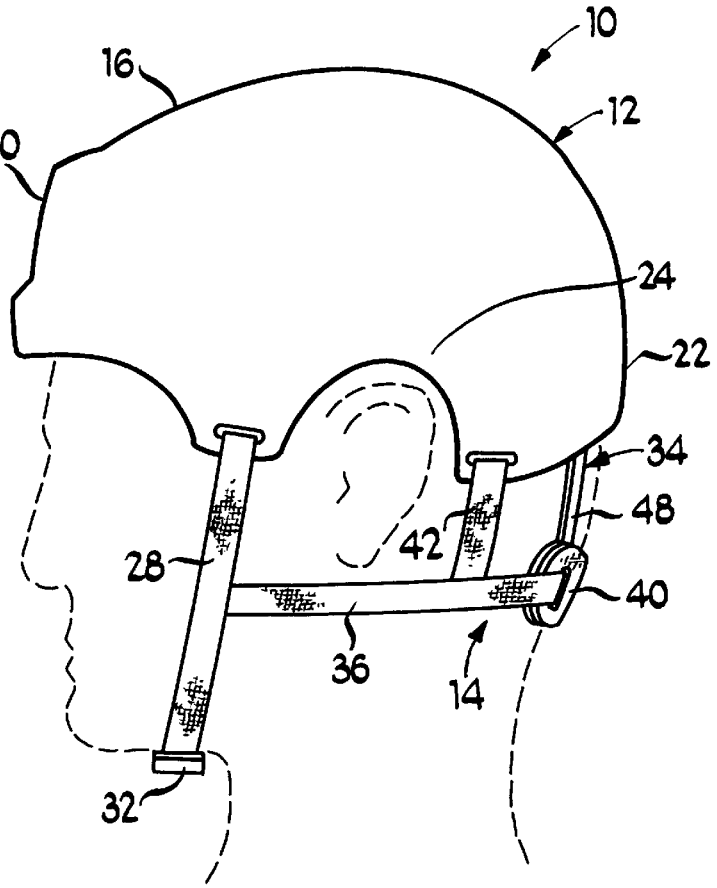
FIG. 1 of the drawings is a side elevation of a first embodiment of the protective helmet of the present invention.

While this invention is susceptible of embodiment in many different forms, there is shown in the drawings and will herein be described in detail, two specific embodiments with the understanding that the present disclosure can be considered as an exempilification of the principles of the invention and is not intended to limit the invention to the embodiments illustrated.

Figure 2:
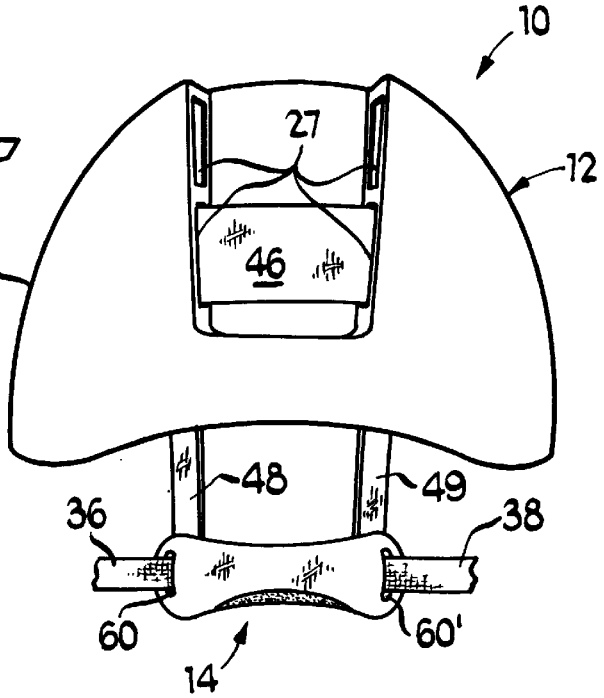
FIG. 2 of the drawings is a partial rear elevation of the first embodiment of the invention.
Figure 3:
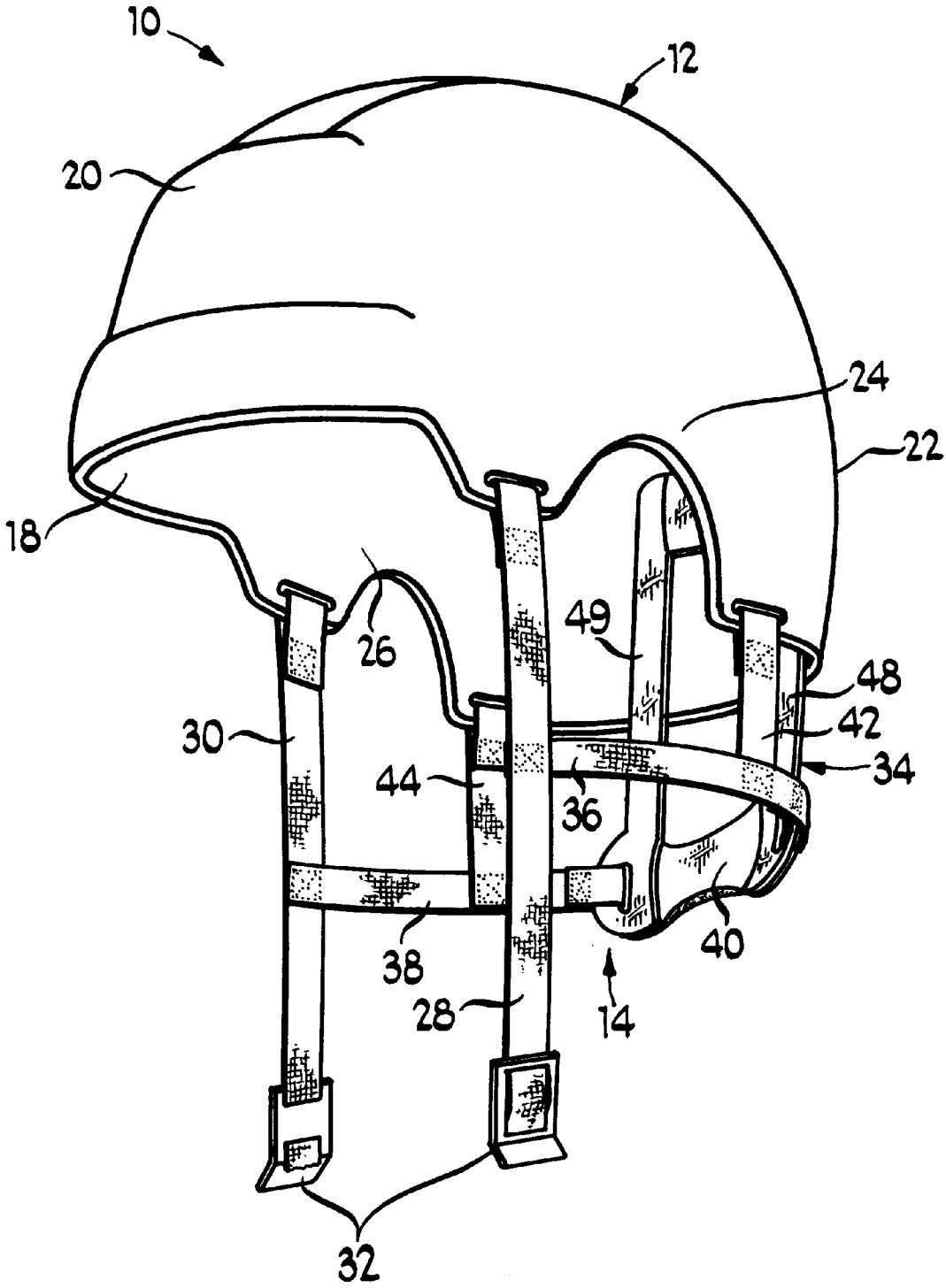
FIG. 3 of the drawings is a perspective view of the first embodiment of the present invention.

Protective helmet 10 is shown in FIGS. 1–3 as comprising protective shell 12 and releasable attachment means 14. Protective shell includes outer surface 16, inner surface 18 (FIG. 3), front region 20, rear region 22, first side region 24, second side region 26 (FIG. 3) and openings, such as opening 27. Protective shell 16 is preferably made of a high strength plastic material that is specifically designed to absorb an impact imparted thereto—although other conventionally used helmet shell materials are likewise contemplated. In fact, many currently available helmets can be retrofit to include the above features of protective helmet 10.

Releasable attachment means 14 is shown in FIGS. 1–3 as comprising first front strap 28, second front strap 30, attachment member 32, rear strap 34, first side strap 36, second side strap 38, rear plate 40, first support strap 42 and second support strap 44. As will be explained, the releasable attachment means releasably attaches the protective shell to the user and maintains the protective shell in the proper orientation relative to the user.

First and second front straps 28, 30, respectively, are shown in FIGS. 1–3 as extending about either side region of the protective shell. Specifically, first front strap 28 extends from the first side region of the helmet in a downward direction. Similarly, second front strap 29 extends from the second side region of the helmet in a downward direction. Of course, the first and second front straps may comprise a single strap that extends from the first side region to the second side region along either the inner surface or outer surface of protective shell 12.

As shown in FIG. 1, the two straps join at attachment member 32. Indeed, attachment member 32 releasably attaches the two straps below the chin of the user. The attachment member may be adjusted to properly and securely retain the protective shell about the user. As such, attachment member 32 may comprise a hook and loop fastener, a buckle member, a series of snaps as well as a multitude of other structures that facilitate releasable attachment.

Figure 4:
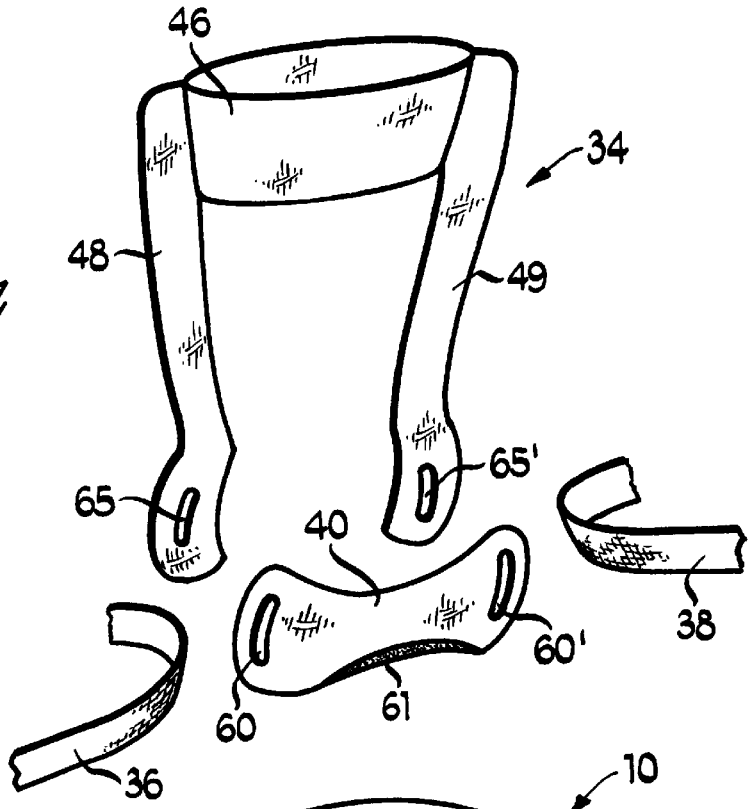
FIG. 4 of the drawings is a perspective view of the rear strap and the rear plate.

Rear strap 34 is shown in FIG. 4 as comprising outer region 46, first lower extension region 48 and second lower extension region 49. As shown in FIG. 3, rear strap 34 is positioned relative to protective shell 12 so that lower extension regions 48 and 49 extend through openings 27 (FIG. 2) in protective shell 12 until outer region 46 abuts outer surface 16 (FIG. 2) of the protective shell. It is contemplated that rear strap 34 may comprise a single integrated molded material, or multiple members that are attached to each other. Additionally, rear strap 34 preferably comprises a material that is substantially flexible, yet rigid enough so as to resist deformation.

Each of lower extension regions 48 and 49 are shown in FIG. 4 as including openings 65, 65', respectively, positioned proximate the lowest point thereof. As will be explained, these openings accept side straps 36, 38, respectively, for operable attachment thereto. Of course, other attachment configurations such as hook and loop material, snaps, buckles, etc. are likewise contemplated.

As will be explained relative to its operation and use, the spaced apart lower extension regions 48 and 49 essentially render a means for cradling the user's head. Specifically, the rear portion of the user's head is effectively retained on either side by the lower extension regions, so that regardless of outside influence, the rear region of the user's head is maintained, or cradled, between the two lower extension regions. As will be explained, although not necessary, it is preferred that the extension regions cooperate with rear plate 40 to provide enhanced cradling stability.

Rear plate 40 is shown in FIG. 4 as including openings 60, 60' and contoured perimeter 61. Openings 60, 60' are positioned on either end of the rear plate and are substantially symmetrical about a longitudinal axis through the rear plate. Openings 60, 60' substantially correspond to openings 65, 65' of the rear strap for acceptance of side straps 36 and 38. Although contoured perimeter 61 is configured to follow the contours of the lower rear region of a user's head, other configurations are likewise contemplated.

First side strap 36 and second side strap 38 are shown in FIG. 3 as extending from the respective front strap to the rear strap and the rear plate. Specifically, first side strap 36 extends from first front strap 28 through opening 65 of lower region 48 and through opening 60 of rear plate 40. Likewise, second side strap extends from second front strap 30 through opening 65' of lower region 49 and through opening 60' of rear plate 40. Through first and second side straps 36, 38, the lower regions are releasably associated with rear plate 40. While other configurations are contemplated, first and second side straps 36, 38 may comprise a single strap member that extends from first front strap 24 through rear strap 32 and through rear plate 40 to second front strap 30.

First support strap 42 and second support strap 44 are shown in FIG. 1. The first support strap extends from first side region 24 of protective shell 12 to first side strap 36. Similarly second support strap 44 extends from second side region 26 of protective shell 12 to second side strap 38. The support straps further serve to maintain the side straps in the proper position and prevent inadvertent and undesired repositioning of the side straps. It is likewise contemplated that the support straps may comprise a single strap that extends to both side regions of the protective shell about the inner or outer surface thereof. Of course, for certain particular applications one or both of the support straps may be eliminated.

Figure 5:
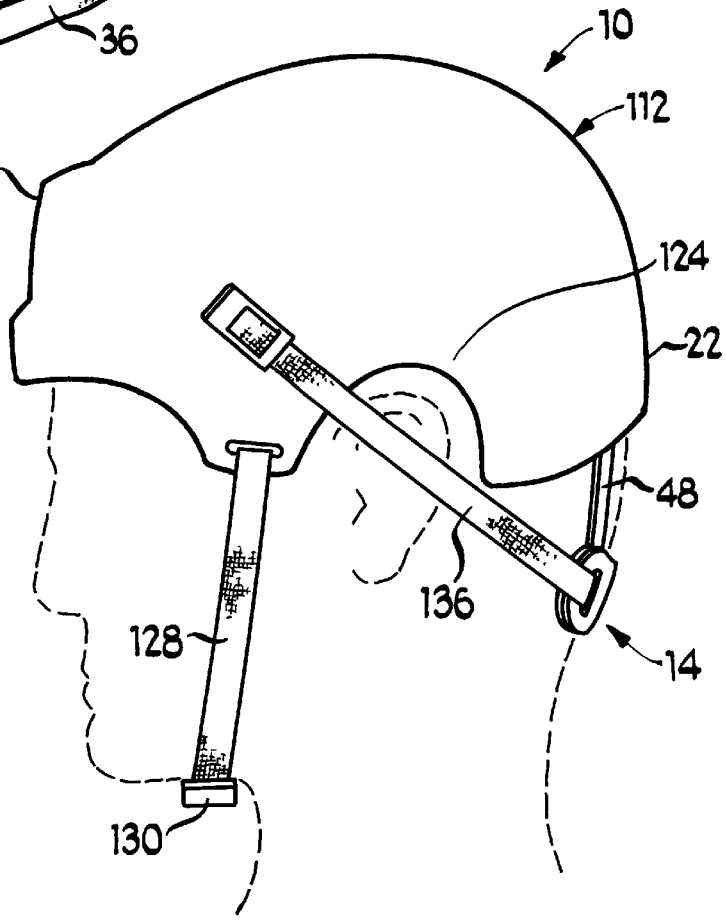
FIG. 5 of the drawings is a side elevation of a second embodiment of the protective helmet of the present invention.

In another embodiment (as shown in FIG. 5), first side strap 136 is associated with first side region 124 of protective shell 112 and second side strap 138 is associated with the second side region (not shown) of the protective shell. In such an embodiment, the front straps 128 and 130 and the associated side straps 136 and 138 are not operatively connected to each other. Accordingly, the front straps are, in effect, a chin strap which maintains vertical movement of the helmet, while the side strap abuts the occipital region of the user's head so as to limit rotational movement of the helmet. As a result, separate attachment and adjustment mechanisms are contemplated for such features.

In operation, protective helmet 10 may be used by an athlete playing a variety of contact sports, such as hockey. To utilize protective helmet 10, the user first positions protective shell 12 on his or her head so that front region 20 corresponds to the front of the user's head and rear region 22 corresponds to the rear of the user's head. It is contemplated that the protective helmet comes in a variety of sizes so that a snug and proper fit can be obtained for all prospective users.

Once positioned properly, as shown in FIG. 1, first front strap 28 extends in front of the user's ear. First support strap 42 (available in one embodiment) extends just behind the user's ear. Similarly, while not shown, it will be understood that second front strap 30 (FIG. 3) extends in front of the user's ear, and second support strap 44 (FIG. 3) extends just behind the user's ear. Rear strap 34 extends to an area just below the rear region of the user's head. As a result, rear plate 40 extends between lower extensions 48 and 49 (FIG. 1 and FIG. 3), just below the occipital region of the user's head. First side strap 36 extends from first front strap 28 to rear strap 34, just below the ear of the user. Additionally, second side strap 38 extends from the second front strap to the rear strap just below the ear of the user.

Through attachment member 32, first and second front straps are attached to each other below the chin of the user. The attachment member is adjustable so that a good snug fit can be achieved. Specifically, when properly adjusted the first and second front straps are snugly positioned relative to the side of the user's head. Moreover, the rear strap, and the rear plate are snugly forced against the user's head (and occipital region thereof) and held in position through the side straps.

As shown in FIG. 1, by extending first and second lower extension regions 48, 49 (FIG. 1 and FIG. 3) through two different openings of the protective shell and as the lower extension regions are pulled away from the protective shell, first lower extension region 48 works against second lower extension region 49, thereby creating a strong anchoring structure for the rear plate and the side straps relative to the helmet. Further, as explained above, the spaced apart lower extension regions serve to cradle the rear portion of the head. Accordingly, as the protective shell is hit from a front side, the helmet resists any rotational movement about an axis extending approximately through the ears of the user as well as about an axis longitudinally through the user's body. Inasmuch as the protective helmet resists any movement relative to the head of the user, the helmet is always properly positioned to absorb impacts that are imparted upon the user.

The foregoing description and drawings merely explain and illustrate the invention and the invention is not limited thereto except insofar as the appended claims are so limited, as those skilled in the art who have the present disclosure before them will be able to make modifications and variations therein without departing from the scope of the invention

We claim:

1. A protective helmet comprising:

a protective shell having a front region, a rear region and a first and second side region;

means for releasably attaching the helmet to a user, the releasable attachment means comprising:

a first front strap extending from the first side region of the protective shell;

a second front strap extending from the second side region of the protective shell;

an attachment member associated with each of the first and second front straps;

means for cradling a rear portion of the head of the user;

a rear plate associated with the cradling means;

a first side strap extending from at least one of the cradling means and the rear plate to at least one of the first side region and the first front strap;

a second side strap extending from the at least one of the cradling means and the rear plate to at least one of the second side region and the second front strap; and a first support strap extending from the first side strap to the first side region of the protective shell.

2. A protective helmet comprising:

a protective shell having a front region, a rear region and a first and second side region;

means for releasably attaching the helmet to a user, the releasable attachment means comprising:

a first front strap extending from the first side region of the protective shell;

a second front strap extending from the second side region of the protective shell;

an attachment member associated with each of the first and second front straps;

means for cradling a rear portion of the head of the user;

a rear plate associated with the cradling means;

a first side strap extending from at least one of the cradling means and the rear plate to at least one of the first side region and the first front strap;

a second side strap extending from the at least one of the cradling means and the rear plate to at least one of the second side region and the second front strap; and a support strap extending from the second side strap to the second side region of the protective shell.

3. A protective helmet comprising:

a protective shell having a front region, a rear region and a first and second side region;

means for releasably attaching the helmet to a user, the releasable attachment means comprising:

a first front strap extending from the first side region of the protective shell;

a second front strap extending from the second side region of the protective shell;

an attachment member associated with each of the first and second front straps;

means for cradling a rear portion of the head of the user;

a rear plate associated with the cradling means;

a first side strap extending from at least one of the cradling means and the rear plate to at least one of the first side region and the first front strap;

a second side strap extending from the at least one of the cradling means and the rear plate to at least one of the second side region and the second front strap;

wherein the cradling means further comprises at least two lower extension regions associated with the rear region of the protective shell, the at least two lower extension regions spaced apart a predetermined distance forming a gap therebetween.

4. The protective helmet according to claim 3 wherein the at least two lower extension regions are each associated with the rear plate.

5. The protective helmet according to claim 4 wherein the at least two lower extension regions comprises a first lower extension region and a second lower extension region, the first side strap coupling the first lower extension region and the rear plate, and the second side strap coupling the second lower extension region and the rear plate.

6. The protective helmet according to claim 3 wherein:

the protective shell further includes an outer surface and an inner surface, the rear region of the protective shell includes at least two openings extending from the inner surface through to the outer surface, a portion of the cradling means extending along at least a portion of the outer surface of the rear region and through at least two of the at least two openings of the protective shell.

7. The protective helmet according to claim 6 wherein the cradling means comprises a single substantially U-shaped member.

8. The protective helmet according to claim 3 wherein the first and second side straps comprise a single strap member.

9. The protective helmet according to claim 3 wherein:

the first side strap is coupled with the first front strap; and the second side strap is coupled with the second front strap.

10. The protective helmet according to claim 4 further including means for releasably attaching the first and second side straps to the protective shell.

11. The protective helmet according to claim 3 wherein the first and second side straps and the first and second front straps comprise a single integrally molded member.

12. The protective helmet according to claim 3 wherein the rear plate comprises a resilient, yet flexible material.

13. The protective helmet according to claim 3 wherein the rear plate comprises a resilient, yet flexible material.

14. A protective helmet comprising:

a protective shell having a front region, a rear region, a first and a second side region, an outer surface and at least two openings;

means for releasably attaching the helmet to a user, the releasable attachment means comprising:

a first front strap extending from the first side region of the protective shell;

a second front strap extending from the second side region of the protective shell;

an attachment member associated with each of the first and the second front straps;

a rear strap including an outer region and two lower extension regions, the outer region extending along the outer surface of the protective shell and the two lower extension regions extending through the at least two openings of the protective shell, the two extension regions associated with at least one of the first and the second front straps;

a first side strap extending from the rear strap to at least one of the first side region and the first front strap; and a second side strap extending from the rear strap to at least one of the second side region and the second front strap.

15. The protective helmet according to claim 14 further comprising at least one support strap associated with at least one of the first and second side straps and the protective shell.

16. The protective helmet according to claim 14 further comprising means for cradling a rear region of a head of a user.

17. The protective helmet according to claim 16 wherein the cradling means comprises the positioning of the two lower extension regions at a spaced apart distance from each other.

* * * * *